US008240096B2

(12) United States Patent
Kim

(10) Patent No.: US 8,240,096 B2
(45) Date of Patent: Aug. 14, 2012

(54) BRACKET STRUCTURE FOR INCREASING LOAD-CARRYING CAPACITY OF CONCRETE STRUCTURE AND ENABLING EASY CONSTRUCTION

(75) Inventor: Sang-hyo Kim, Seoul (KR)

(73) Assignees: Industry-Academic Cooperation Foundation (KR); Yonsei University (KE)

( * ) Notice: Subject to any disclaimer, the term of this patent is extended or adjusted under 35 U.S.C. 154(b) by 6 days.

(21) Appl. No.: 12/887,670

(22) Filed: Sep. 22, 2010

(65) Prior Publication Data

US 2012/0000153 A1 Jan. 5, 2012

(30) Foreign Application Priority Data

Jul. 2, 2010 (KR) ..... 10-2010-0063925

(51) Int. Cl.
*E04C 5/08* (2006.01)

(52) U.S. Cl. ..... 52/223.14; 52/223.13; 52/223.6; 52/223.8

(58) Field of Classification Search ..... 52/231, 52/223.8, 223.9, 223.14, 223.13, 223.11, 52/223.6, 223.1, 295, 414, 432
See application file for complete search history.

(56) References Cited

U.S. PATENT DOCUMENTS

| | | | | | |
|---|---|---|---|---|---|
| 2,315,634 | A * | 4/1943 | McCall | 249/179 |
| 2,675,695 | A * | 4/1954 | Coff | 52/223.8 |
| 2,952,061 | A * | 9/1960 | Warner | 264/31 |
| 3,216,162 | A * | 11/1965 | Gerber et al. | 52/223.13 |
| 3,225,499 | A * | 12/1965 | Kourkene | 52/223.13 |
| 3,282,017 | A * | 11/1966 | Rothermel | 52/745.19 |
| 3,283,456 | A * | 11/1966 | Carlton | 52/223.6 |
| 3,283,461 | A * | 11/1966 | Hadley | 52/334 |
| 3,343,320 | A * | 9/1967 | Krajcinovic et al. | 52/252 |
| 3,368,016 | A * | 2/1968 | Birguer | 264/228 |
| 3,387,417 | A * | 6/1968 | Howlett | 52/223.13 |
| 3,398,491 | A * | 8/1968 | Babcock | 52/90.1 |
| 4,065,907 | A * | 1/1978 | Rice | 52/745.13 |
| 5,016,338 | A * | 5/1991 | Rowan, Jr. | 29/423 |
| 5,115,622 | A * | 5/1992 | Ammann et al. | 52/741.3 |
| 5,289,626 | A * | 3/1994 | Mochida et al. | 29/452 |
| 5,379,563 | A * | 1/1995 | Tinsley | 52/295 |
| 5,467,569 | A * | 11/1995 | Chiodo | 52/713 |
| 5,479,748 | A * | 1/1996 | Siller | 52/231 |
| 5,617,685 | A * | 4/1997 | Meier et al. | 52/223.8 |
| 5,671,572 | A * | 9/1997 | Siller-Franco | 52/223.8 |
| 5,836,132 | A * | 11/1998 | Weathersby | 52/702 |
| 7,305,802 | B1 * | 12/2007 | Plavidal | 52/291 |
| 7,441,743 | B2 * | 10/2008 | Behlinger et al. | 248/679 |
| 7,677,522 | B2 * | 3/2010 | Bakos | 248/500 |
| 2002/0095892 | A1 * | 7/2002 | Johnson | 52/295 |
| 2008/0190058 | A1 * | 8/2008 | Migliore | 52/295 |
| 2011/0072745 | A1 * | 3/2011 | Pantelides et al. | 52/223.13 |

* cited by examiner

*Primary Examiner* — Robert Canfield
*Assistant Examiner* — Babajide Demuren
(74) *Attorney, Agent, or Firm* — Cantor Colburn LLP

(57) ABSTRACT

Disclosed herein is a bracket structure for increasing strength of a concrete structure and enabling easy construction. The bracket structure includes an affixing bracket and a pre-stressing steel plate. The affixing bracket comprises a holding member connected to a bottom of the concrete structure using an anchor bolt, and a support member connected to the holding member and forming a channel to increase the moment of inertia of area of the concrete structure. The pre-stressing steel plate is connected to the support member of the affixing bracket, and applies stress to the concrete structure.

9 Claims, 5 Drawing Sheets

[ A ]

[ B ]

[ A ]

[ B ]

[ A ]

[ B ]

BRACKET STRUCTURE FOR INCREASING LOAD-CARRYING CAPACITY OF CONCRETE STRUCTURE AND ENABLING EASY CONSTRUCTION

BACKGROUND OF THE INVENTION

1. Field of the Invention

The present invention relates to a bracket structure for increasing the load-carrying capacity and reinforcing the strength of a concrete structure and enabling easy construction, which solves the problems wherein, if an obstacle is present on the surface of concrete structure or an anchor bolt is directly subjected to the resistance force of a steel plate when the steel plate applying stress to the concrete structure is integrally secured to the bottom of the concrete structure using the anchor bolt, the steel plate as well as the anchor bolt is deformed, so that pre-stressing effect is weakened, and it is difficult to maintain permissible tolerance when installing the anchor bolt and the steel plate, because of the strain of the anchor bolt, and thereby the detail of the construction work is inaccurate and the installation of the steel plate to the concrete structure is not easy, and which uses an affixing bracket including a holding member which is connected to the bottom of a concrete structure using an anchor bolt, and a support member which is connected to a pre-stressing steel plate applying stress to the concrete structure connected to the holding member, thus making it easy to install the pre-stressing steel plate regardless of the condition of the bottom surface of the concrete structure or tolerance when installing the anchor bolt and the steel plate, and in which the support member of the affixing bracket forms a channel under the concrete structure to enlarge an area, thus increasing the moment of inertia of area of the concrete structure.

2. Description of the Related Art

Generally, the concrete structure is comprised of a beam of a building, a slab or a concrete girder of a bridge, and serves to bear the load of the building or bridge.

When a dead load (fixed load) or live load is applied to the concrete structure, the upper surface of the concrete structure CC is subjected to compression strain or stress.

In contrast, the bottom surface of the concrete structure CC is subjected to tension strain or stress.

However, in terms of the characteristics of the material of the concrete structure, it has high resistance to compression, but has low resistance to tension.

In order to overcome the weakness, a steel plate or a steel member is provided on the bottom surface of the concrete structure to apply stress thereto, thus increasing a load bearing capacity and strength of a concrete structure which has been installed or is being installed.

Thus, as shown in FIG. 1, in order to install a steel member or a pre-stressing steel plate 20 to a concrete structure CC, anchor bolts 1 are put in both ends of the bottom surface of the structure CC.

Further, a fastening hole is formed in each end of the pre-stressing steel plate 20 to engage an associated anchor bolt 1. After the anchor bolt 1 is inserted into the fastening hole of the pre-stressing steel plate 20, a nut 5 is screwed onto the anchor bolt 1, thus integrally coupling the concrete structure CC with the pre-stressing steel plate 20.

Moreover, an additional member such as a friction plate 7 is interposed between the concrete structure CC and the pre-stressing steel plate 20, thus realizing the smooth behavior of the concrete structure CC and the pre-stressing steel plate 20.

However, as in the prior art, when the pre-stressing steel plate 20 is directly secured to and integrated with the concrete structure CC, the following problems may occur.

That is, when a protrusion or an uneven obstacle is present on the surface of the conventional concrete structure CC, it is difficult to directly fix the pre-stressing steel plate 20 to the surface of the concrete structure CC, so that constructability is poor.

Further, since the anchor bolts 1 are directly subjected to the resistance force of the pre-stressing steel plate 20 against the compression strain or stress engaged on the bottom surface of the concrete structure CC, the pre-stressing steel plate 20 as well as the anchor bolts 1 is deformed, and the pre-stressing effect of the steel plate 20 is weakened.

Furthermore, because of the strain of the anchor bolts 1, it is difficult to maintain tolerance within a permissible range when installing the anchor bolts 1 and the pre-stressing steel plate 20, so that the detail of the construction work is inaccurate.

Further, it is not easy to install the pre-stressing steel plate 20 to the anchor bolts, so that constructability is poor.

SUMMARY OF THE INVENTION

Accordingly, the present invention has been made keeping in mind the above problems occurring in the prior art, and an object of the present invention is to provide a bracket structure for reinforcing and increasing the strength of a concrete structure and enabling easy construction, which uses an affixing bracket including a holding member which is connected to the bottom of a concrete structure using an anchor bolt, and a support member which is connected to a pre-stressing steel plate applying stress to the concrete structure connected to the holding member, thus making it easy to install the pre-stressing steel plate to the anchor bolts regardless of the condition of the bottom surface of the concrete structure or tolerance when installing the anchor bolt and the steel plate, and in which the support member of the affixing bracket forms a channel under the concrete structure to enlarge an cross section area, thus increasing the moment of inertia of area of the concrete structure.

Another object of the present invention is to provide a bracket structure for increasing the strength of a concrete structure and enabling easy construction, which changes the shape and connecting structure of an affixing bracket and a pre-stressing steel plate in various ways, thus allowing a form suited to the shape or condition of the concrete structure to be selected, therefore more effectively coping with various parameters in construction and further upgrading the ease of construction.

In order to accomplish the above objects, the present invention provides a bracket for increasing strength and load-carrying capacity of a concrete structure and enabling easy construction, including an affixing bracket which comprises a holding member connected to a bottom surface of the concrete structure using an anchor bolt, and a support member connected to the holding member and forming a channel to increase a second moment of area of the concrete structure, and a pre-stressing steel plate connected to the support member of the affixing bracket and applying stress to the concrete structure.

The support member of the affixing bracket may be connected to the pre-stressing steel plate by welding.

The support member of the affixing bracket may be connected to the pre-stressing steel plate by a high tension bolt.

An extension part may be provided on the holding member in such a way as to be placed outside the support member, and the extension part may include a fastening hole, so that the holding member is fixed to the concrete structure using the anchor bolt.

The holding member and the support member of the affixing bracket may be connected to each other by welding.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
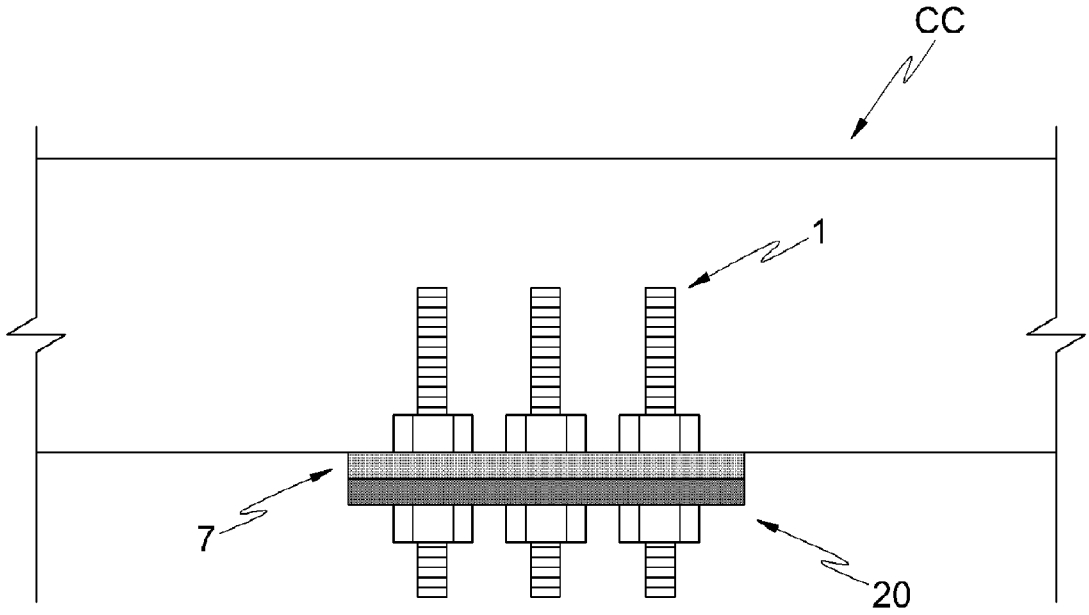
FIG. 1 Prior Art
FIG. 1 is a sectional view illustrating a conventional connecting structure of a concrete structure and a pre-stressing steel plate.
Figure 2:
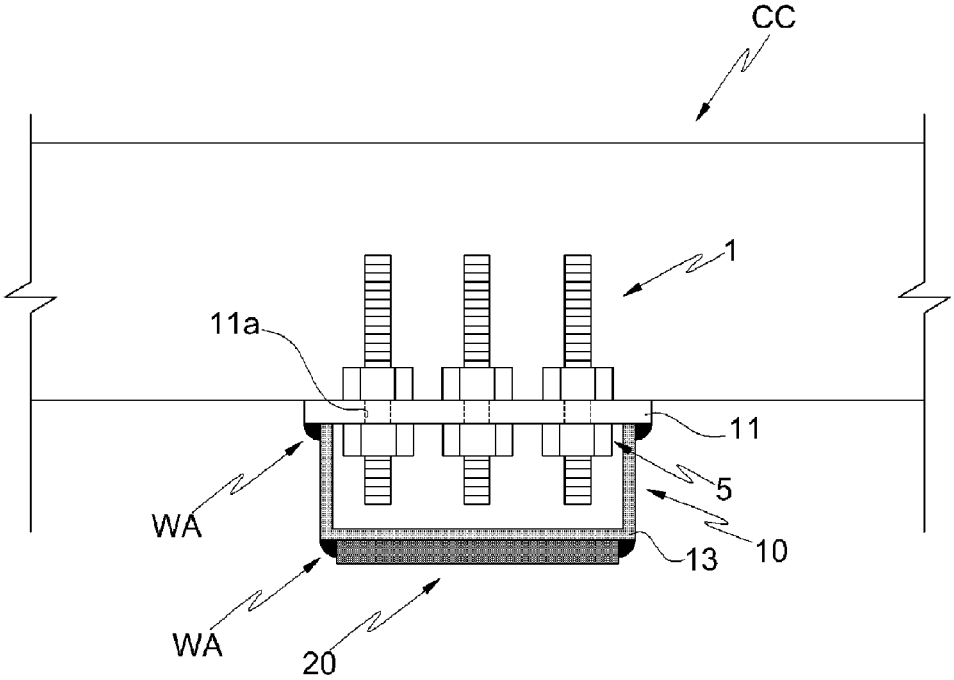
FIGS. 2A and 2B are sectional views illustrating a bracket for increasing the strength of a concrete structure and enabling easy construction according to the present invention.
Figure 2:
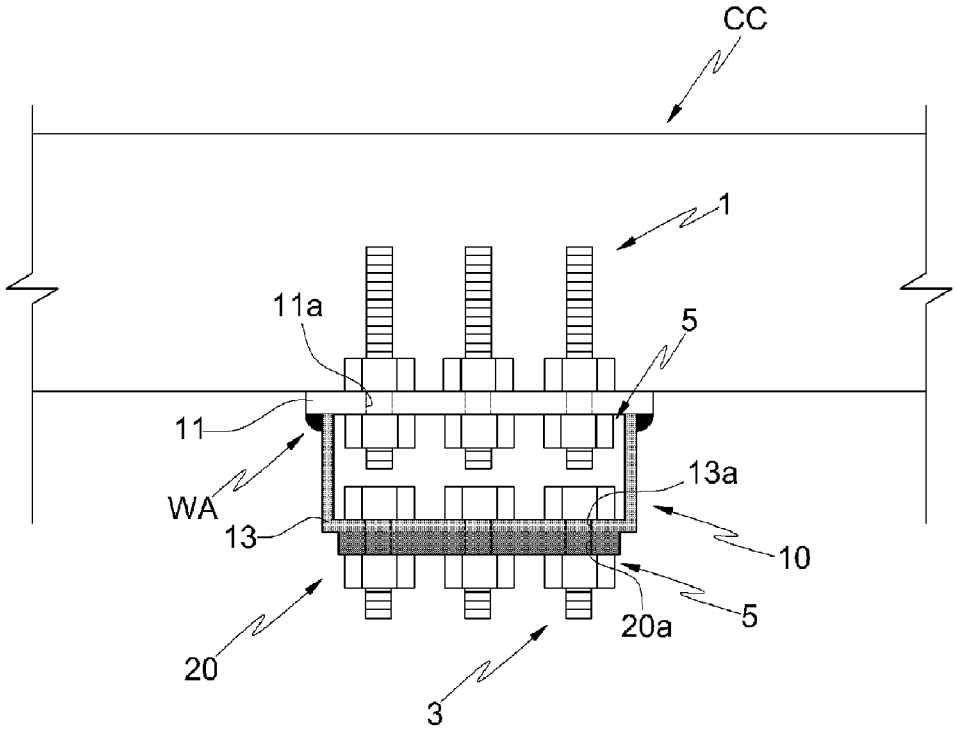
Figure 3:
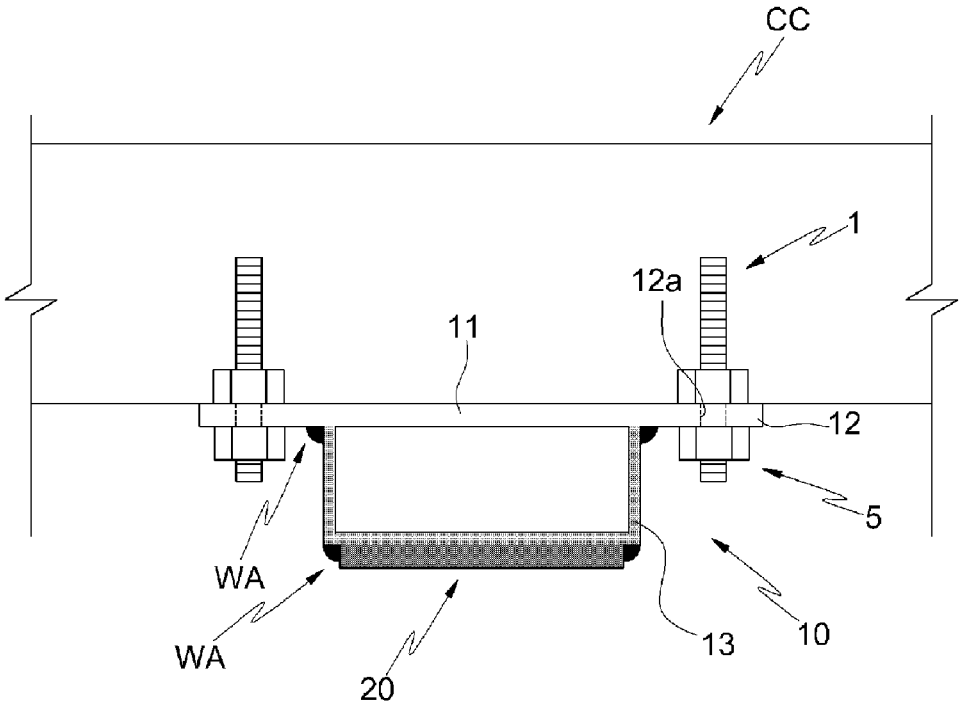
FIGS. 3A and 3B are sectional views illustrating a bracket according to a modification of the present invention.
Figure 3:
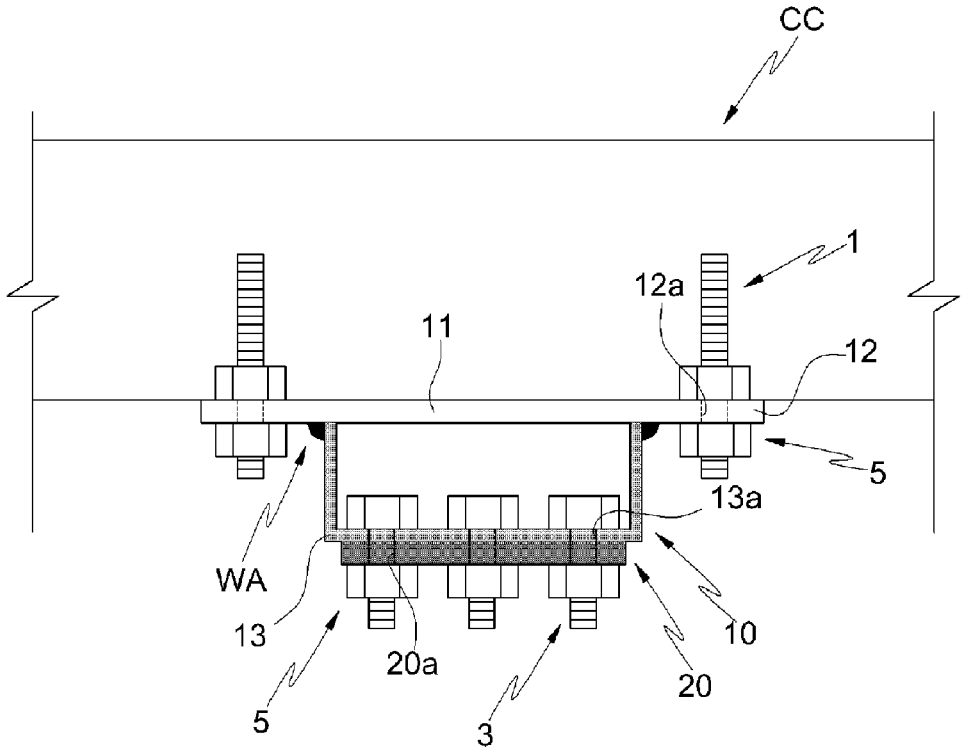
Figure 4:
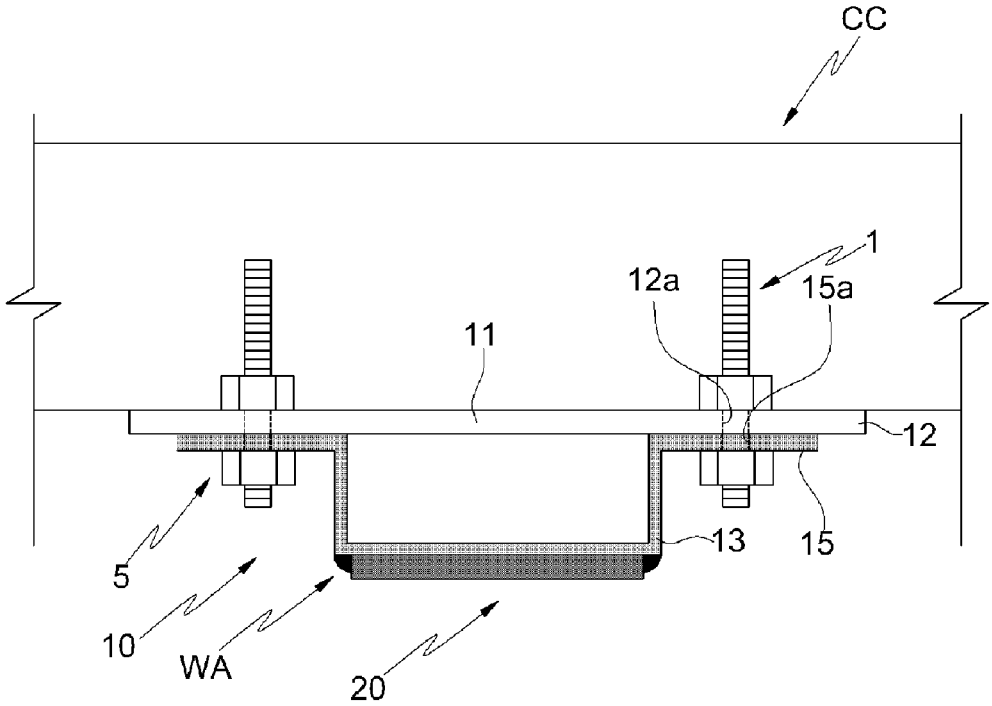
FIGS. 4A and 4B are sectional views illustrating a bracket according to another modification of the present invention.
Figure 4:
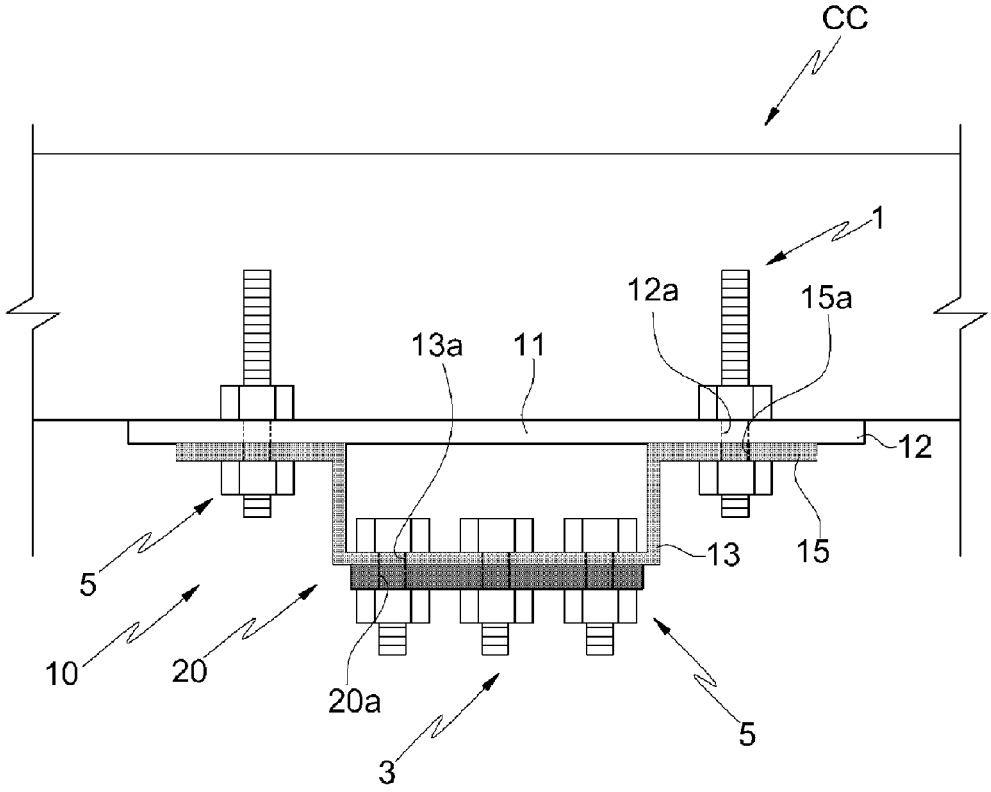

Hereinafter, a bracket structure for reinforcing the strength and increasing load-carrying capacity of a concrete structure and enabling easy construction according to the present invention will be described in detail with reference to the accompanying drawings.

As shown in FIGS. 1 to 4A and 4B, the bracket structure for reinforcing the strength and increasing load-carrying capacity of the concrete structure and enabling easy construction according to the present invention includes an affixing bracket 10 and a pre-stressing steel plate 20. The affixing bracket 10 comprises a holding member 11 which is connected to the bottom surface of a concrete structure CC using anchor bolts 1, and a support member 13 which is connected to the holding member 11 and forms a channel to increase the moment of inertia of area of the concrete structure CC. The pre-stressing steel plate 20 is connected to the support member 13 of the affixing bracket 10, and applies stress to the concrete structure CC.

First, the concrete structure CC according to the present invention is a beam of a building, a slab or a concrete girder of a bridge, and serves to bear the load of the building or bridge.

When dead load (fixed load) or live load (hereinafter, referred to as 'working load') is applied to the concrete structure CC, the upper surface of the concrete structure CC is subjected to compression strain or stress.

In contrast, the bottom surface of the concrete structure CC is subjected to tension strain or stress.

However, in terms of the characteristics of the material of the concrete structure CC, it has high resistance to compression, but has low resistance to tension.

In order to overcome the weakness, a steel plate or a steel member is provided on the bottom surface of the concrete structure CC to apply stress thereto, thus increasing load bearing capacity and reinforcing strength of a concrete structure CC which has been installed or is being installed.

Thus, according to the prior art shown in FIG. 1, in order to install a steel plate or a steel pre-stressing steel plate 20 to a concrete structure CC, anchor bolts 1 are put in both ends of the bottom surface of the structure CC.

Further, a fastening hole is formed in each end of the pre-stressing steel plate 20 to engage an associated anchor bolt 1. After the anchor bolt 1 is inserted into the fastening hole of the pre-stressing steel plate 20, a nut 5 is screwed onto the anchor bolt 1, thus integrally coupling the concrete structure CC with the pre-stressing steel plate 20.

Moreover, an additional member such as a friction plate 7 is interposed between the concrete structure CC and the pre-stressing steel plate 20, thus realizing the smooth behavior of the concrete structure CC and the pre-stressing steel plate 20.

However, as in the prior art, when the pre-stressing steel plate 20 is directly fixed to and integrated on the bottom surface of the concrete structure CC, the following problems may occur.

That is, when a protrusion or an uneven obstacle is present on the conventional concrete structure CC, it is difficult to directly secure the pre-stressing steel plate 20 to the bottom of the concrete structure CC, so that constructability is poor.

Further, since the anchor bolts 1 are directly subjected to the resistance force of the pre-stressing steel plate 20 against the compression strain or stress engaged on the bottom surface of the concrete structure CC, the pre-stressing steel plate 20 as well as the anchor bolts 1 is deformed, and the pre-stressing effect of the steel plate 20 is weakened.

Furthermore, because of the strain of the anchor bolts 1, it is difficult to maintain tolerance within a permissible range when installing the anchor bolts 1 and the pre-stressing steel plate 20, so that the detail of the construction work is inaccurate. Further, it is not easy to install the anchor bolts 1 and the pre-stressing steel plate 20, so that constructability is poor.

Therefore, the present invention provides the bracket structure which solves the above problems and increases the load-carrying capacity and reinforcing the strength of the concrete structure CC.

Hereinafter, the coupling between respective parts of the affixing bracket 10 according to the present invention and the functional characteristics thereof will be described in detail.

As shown in FIGS. 2A and 2B to 4A and 4B, in the bracket for increases the load-carrying capacity and reinforcing the strength of the concrete structure and enabling easy construction according to the present invention, the affixing bracket 10 comprises the holding member 11 which is connected to the bottom of the concrete structure CC using the anchor bolts 1, and the support member 13 which is connected to the holding member 11 and forms the channel to increase the moment of inertia of area of the concrete structure CC.

In the affixing bracket 10 according to the present invention, the holding member 11 is a plate-shaped member. A plurality of coupling holes 11*a* is formed in the holding member 11 to receive the anchor bolts 1 which are provided on both ends on the bottom of the concrete structure CC.

After the anchor bolts 1 are inserted into the coupling holes 11*a* of the holding member 11, the nuts 5 are screwed onto the corresponding anchor bolts 1 to secure the holding member 11 to the concrete structure CC.

Further, in the affixing bracket 10 according to the present invention, the support member 13 is formed into a 'U' shape by bending opposite sides of a plate-shaped member upwards.

After the upper end of the support member 13 makes contact with the bottom of the holding member 11, junctions between the support member 13 and the holding member 11 are welded from the exterior, thus forming welding parts WA (which are not present in FIGS. 4A and 4B).

Thereby, the support member 13 defines the channel of a predetermined height under the holding member 11.

The affixing bracket 10 according to the present invention may solve the problems occurring in the conventional structure wherein the pre-stressing steel plate 20 is directly secured and integrated with the bottom surface of the concrete structure CC using the anchor bolts 1.

In order to solve the problem, the affixing bracket 10 is provided keeping a distance between the pre-stressing steel plate 20 and the bottom surface of the concrete structure CC, thus preventing the pre-stressing steel plate 20 from being directly connected to the bottom surface of the concrete structure CC.

That is, the affixing bracket 10 causes the pre-stressing steel plate 20 to be spaced apart from the bottom surface of the concrete structure CC by a predetermined interval, thus making it easy to install the pre-stressing steel plate 20 regardless of whether obstacles are present on the bottom surface of the concrete structure CC, therefore achieving easy works.

Further, the pre-stressing steel plate 20 and the anchor bolts 1 are not directly connected to each other because of the affixing bracket 10. Even when the anchor bolts 1 are deformed by the working load applied from above the concrete structure CC, the pre-stressing steel plate 20 can be prevented from being deformed, unlike the conventional structure.

Thus, a reduction in pre-stressing effect of the pre-stressing steel plate 20 can be prevented.

Further, even though the anchor bolts 1 are deformed by the working load applied from the concrete structure CC, the pre-stressing steel plate 20 is not directly connected to the anchor bolts 1, but the pre-stressing steel plate 20 is connected to the anchor bolts 1 via the affixing bracket 10, so that the detail of the construction work can be maintained within permissible tolerance levels.

Moreover, it is easier and more convenient to install the pre-stressing steel plate 20, so that the convenience of construction can be further improved upon.

Further, the channel formed under the holding member 11 by the support member 13 functions to increase the sectional area of the concrete structure CC.

The sectional area increased by the installed steel plate raises the moment of inertia of area of the concrete structure CC. As a result, the support member 13 increases the load-carrying capacity of the concrete structure CC, in addition to realizing reinforcing effects.

Meanwhile, FIGS. 3A, 3B, 4A and 4B show various modifications for a bracket structure according to the present invention.

The modifications will be described below in detail.

First, in FIGS. 3A and 3B, the holding member 11 of the affixing bracket 10 further includes extension parts 12 which are placed outside the support member 13.

A fastening hole 12*a* is formed in each extension part 12, so that the holding member 11 is secured to the concrete structure CC using the anchor bolt 1.

In detail, the extension parts 12 are provided to opposite sides of the support member 13 in such a way as to be placed on the outside thereof. After the anchor bolt 1 is inserted into the fastening hole 12*a* of each extension part 12, the nut 5 is screwed onto the anchor bolt 1, so that the holding member 11 is secured to the concrete structure CC.

Next, the structure of FIGS. 4A and 4B is equal to that of FIGS. 3A and 3B in that extension parts 12 are provided on the holding member 11 of the affixing bracket 10.

However, unlike the structure of FIGS. 3A and 3B, the upper portion of the support member 13 is bent to provide a bent part 15 which corresponds to each extension part 12 of the holding member 11.

The bent part 15 has a corresponding fastening hole 15*a* which corresponds to the fastening hole 12*a* of the extension part 12.

In this case, the anchor bolt 1 is inserted into the fastening hole 12*a* of the extension part 12 and the corresponding fastening hole 15*a* of the bent part 15, and the nut 5 is screwed onto the anchor bolt 1, so that the affixing bracket 10 is secured to the concrete structure CC.

That is, the modifications of FIGS. 3A to 4B have been proposed to overcome the problem of FIGS. 2A and 2B wherein, if the anchor bolt 1 is situated in the support member 13 when a worker secures the affixing bracket 10 to the concrete structure CC, it is not easy to screw the nut 5 onto the anchor bolt 1, thus making construction difficult.

Thus, according to the modifications shown in FIGS. 3A to 4B, when a worker secures the affixing bracket 10 to the concrete structure CC, the anchor bolt 1 is exposed to the outside, so that it is possible to screw the nut 5 onto the anchor bolt 1 without any difficulty. As a result, the work of installing the affixing bracket 10 becomes easier, thus enabling easy construction.

As shown in FIGS. 2A to 4B, in the bracket structure for increasing the strength of the concrete structure and enabling easy construction according to the present invention, the pre-stressing steel plate 20 is connected to the support member 13 of the affixing bracket 10, thus applying stress to the concrete structure CC and increasing the strength of the concrete structure CC.

The pre-stressing steel plate 20 according to the present invention resists and counteracts strain and/or stress which is caused by the working load applied from above the concrete structure CC, and especially the strain and/or stress which is caused by tension acting on the bottom of the concrete structure CC, with pre-stress which is applied to the concrete structure CC by upward displacement (or camber) formed by temperature pre-stressing the steel plate or steel member, thus increasing the load bearing capacity and strength of the structure.

To this end, the pre-stressing steel plate 20 is secured to the bottom of the support member 13 on the affixing bracket 10.

The pre-stressing steel plate 20 may be secured to the support member 13 by welding or a bolt.

As shown in FIGS. 2A, 3A, and 4A, in order to secure the pre-stressing steel plate 20 to the support member 13 by welding, the bottom of the support member 13 is put in contact with the upper end of the pre-stressing steel plate 20.

Subsequently, both sides of the upper end of the pre-stressing steel plate 20 which is in contact with the bottom of the support member 13 form the welding parts WA by welding, so that the pre-stressing steel plate 20 is secured to the affixing bracket 10.

Meanwhile, as shown in FIGS. 2B, 3B, and 4B, in order to connect the pre-stressing steel plate 20 to the support member 13 by a bolt fastening method, a plurality of insertion holes 13*a* is formed in the support member 13.

Subsequently, a corresponding insertion hole 20*a* which corresponds to each insertion hole 13*a* of the support member 13 is formed in the pre-stressing steel plate 20.

Thereafter, a high tension bolt 3 is inserted into each insertion hole 13*a* and each corresponding insertion hole 20*a*, and then is fastened by the nut 5, so that the pre-stressing steel plate 20 is secured to the affixing bracket 10.

Figure 5:
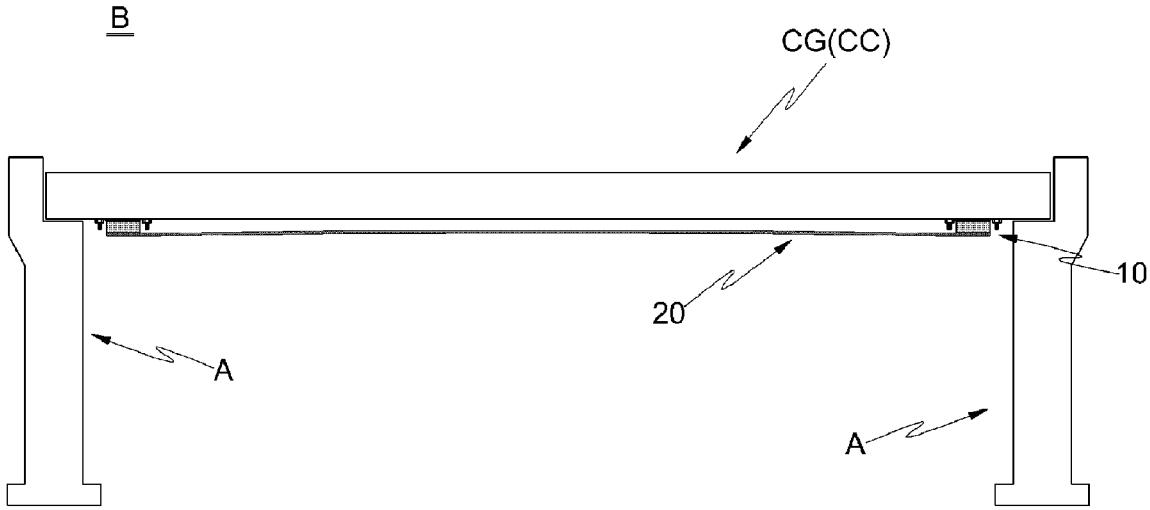
FIG. 5 is a sectional view illustrating the state in which an affixing bracket and a pre-stressing steel plate are installed to the concrete girder of a bridge, according to the present invention.

Finally, FIG. 5 shows the state in which the affixing bracket 10 and the pre-stressing steel plate 20 are installed to the concrete structure according to the present invention, for example, a concrete girder CG which is the upper structure of a bridge B or the concrete structure CC.

In this case, both ends of the concrete girder CG are seated on the upper portion of a pier or an abutment A, and affixing brackets 10 are connected to both sides on the bottom of the concrete girder CG.

Each affixing bracket 10 is connected to the pre-stressing steel plate 20, thus obtaining the above-mentioned function and operational effects.

As described above, the present invention provides a bracket structure for increasing the strength of a concrete structure and enabling easy construction, which uses an affixing bracket including a holding member which is connected to the bottom of a concrete structure using an anchor bolt, and a support member which is connected to a pre-stressing steel plate applying stress to the concrete structure connected to the holding member, thus making it easy to install the pre-stressing steel plate regardless of the condition of the bottom of the concrete structure or tolerance when installing the anchor bolt and the steel plate, and in which the support member of the affixing bracket forms a channel under the concrete structure to enlarge an area, thus increasing the moment of inertia of area of the concrete structure.

The present invention provides a bracket structure for increasing the strength of a concrete structure and enabling easy construction, which changes the shape and connecting structure of an affixing bracket and a pre-stressing steel plate in various ways, thus allowing a form suited to the shape or condition of the concrete structure to be selected, therefore more effectively coping with various parameters in construction and further upgrading the ease of construction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bracket structure, comprising:

an affixing bracket, comprising:

a holding member connected to a bottom of a concrete structure using an anchor bolt; and a support member connected to the holding member at both end portions of the holding member, to form a channel defined by the holding member and the support member to increase a second moment of area of the concrete structure; and a pre-stressing steel plate connected to the support member of the affixing bracket to apply stress to the concrete structure, the pre-stressing steel plate being separated from a surface of the concrete structure by a predetermined distance.

2. The bracket structure as set forth in claim 1, wherein the support member of the affixing bracket is connected to the pre-stressing steel plate by welding.

3. The bracket structure as set forth in claim 1, wherein the support member of the affixing bracket is connected to the pre-stressing steel plate by a high tension bolt.

4. The bracket structure as set forth in claim 1, wherein an extension part is provided on the holding member in such a way as to be placed outside the support member, and the extension part comprises a fastening hole, so that the holding member is secured to the concrete structure using the anchor bolt.

5. The bracket structure as set forth in claim 2, wherein an extension part is provided on the holding member in such a way as to be placed outside the support member, and the extension part comprises a fastening hole, so that the holding member is secured to the concrete structure using the anchor bolt.

6. The bracket structure as set forth in claim 3, wherein an extension part is provided on the holding member in such a way as to be placed outside the support member, and the extension part comprises a fastening hole, so that the holding member is secured to the concrete structure using the anchor bolt.

7. The bracket structure as set forth in claim 1, wherein the holding member and the support member of the affixing bracket are connected to each other by welding.

8. The bracket structure as set forth in claim 2, wherein the holding member and the support member of the affixing bracket are connected to each other by welding.

9. The bracket structure as set forth in claim 3, wherein the holding member and the support member of the affixing bracket are connected to each other by welding.

* * * * *